US011486592B2

(12) United States Patent
McCarty

(10) Patent No.: US 11,486,592 B2
(45) Date of Patent: Nov. 1, 2022

(54) INTEGRATED CHILLED BEAM / CHILLER DIRECT OUTSIDE AIR SYSTEM UNIT

(71) Applicant: Daniel P. McCarty, Edina, MN (US)

(72) Inventor: Daniel P. McCarty, Edina, MN (US)

(73) Assignee: Daniel P. McCarty, Edina, MN (US)

( * ) Notice: Subject to any disclaimer, the term of this patent is extended or adjusted under 35 U.S.C. 154(b) by 66 days.

(21) Appl. No.: 17/101,889

(22) Filed: Nov. 23, 2020

(65) Prior Publication Data

US 2021/0071883 A1 Mar. 11, 2021

Related U.S. Application Data

(63) Continuation of application No. 16/927,515, filed on Jul. 13, 2020, which is a continuation of application No. 15/829,910, filed on Dec. 2, 2017, now Pat. No. 10,712,026.

(60) Provisional application No. 62/429,804, filed on Dec. 3, 2016.

(51) Int. Cl.

| | |
|---|---|
| ***F25D 17/06*** | (2006.01) |
| ***F24F 3/153*** | (2006.01) |
| ***F24F 5/00*** | (2006.01) |
| ***F24F 3/147*** | (2006.01) |
| ***F24F 7/10*** | (2006.01) |
| ***F24F 3/14*** | (2006.01) |

(52) U.S. Cl.

CPC ..... *F24F 3/153* (2013.01); *F24F 3/147* (2013.01); *F24F 3/1423* (2013.01); *F24F 5/0092* (2013.01); *F24F 7/10* (2013.01); *F24F 2203/104* (2013.01); *F24F 2203/1032* (2013.01)

(58) Field of Classification Search

CPC ..... F24F 3/153; F24F 3/1423; F24F 3/147; F24F 5/0092; F24F 7/10; F24F 2203/1032; F24F 2203/104; F24F 2003/1458; F24F 2003/1464; F25B 25/005

USPC ..... 62/90

See application file for complete search history.

(56) References Cited

U.S. PATENT DOCUMENTS 4,189,929 A * 2/1980 Russell ..... F25B 49/02 62/176.5

* cited by examiner

*Primary Examiner* — Henry T Crenshaw
*Assistant Examiner* — Kamran Tavakoldavani
(74) *Attorney, Agent, or Firm* — Merchant & Gould P.C.

(57) ABSTRACT

An air handling system is disclosed that includes an integral chilled water refrigeration system. The air handling system additionally includes a first coil section that provides cooling and a second coil section that provides heating. The second coil section and associated terminal units are in fluid communication with the first refrigeration system.

20 Claims, 6 Drawing Sheets

INTEGRATED CHILLED BEAM / CHILLER DIRECT OUTSIDE AIR SYSTEM UNIT

RELATED APPLICATIONS

This application is a continuation in part of U.S. Ser. No. 16/297,515, filed on Jul. 13, 2020, now abandoned; which is a continuation of U.S. Ser. No. 15/829,910, filed Dec. 2, 2017, now issued as U.S. Pat. No. 10,712,026; which claims priority to U.S. Provisional Application Ser. No. 62/429,804, filed on Dec. 3, 2017. A claim of priority is made to each of the above referenced applications, to the extent appropriate. Each of the above referenced applications are incorporated herein by reference.

BACKGROUND

Systems for conditioning the air in an enclosed space, such as a building are known. Many systems require an air delivery system and chilled and heating water distributions systems. Typically, separate equipment components, such as air handling units, chillers, and boilers, are provided at various locations within the building.

SUMMARY

The present disclosure is directed to a system for conditioning the interior of a building space, for example classrooms and other spaces of a school building. In one aspect, the system includes an air handling system which includes fans for distributing air to and from the building spaces, a first refrigeration system for cooling and dehumidifying air delivered by the air handling system from the outdoors, and a second refrigeration system for reheating the air cooled by the first refrigeration system and for providing cooling to terminal units located within the interior spaces. The system also includes terminal units connected to the air handling unit and to the second refrigeration system such that the terminal units can deliver conditioned air to the space. In one example, the terminal units are induction/displacement terminal units capable of simultaneously providing a heated air flow and a separate cooled displacement air.

In one example, the first refrigeration system is a direct expansion type refrigeration system. In one example, the second refrigeration system is an air-cooled chiller. In one example, the air handling system includes a second fan located between a second air inlet and a second air outlet defining a second airflow path. In one example, the air handling system includes a heat exchanger extending between the first and second airflow paths. In one example, the heat exchanger is a passive desiccant enthalpy wheel.

In one example, an air conditioning system is provided including an air handling unit providing a supply airflow and including a first heat exchanger for cooling the supply airflow, a second heat exchanger for reheating the supply airflow cooled by the first heat exchanger, a first refrigeration system providing cooling to the first heat exchanger, and a second refrigeration system providing cooling to the second heat exchanger. The air conditioning system can also include a plurality of terminal units in fluid communication with the supply airflow generated by the air handling unit. The air conditioning system can also include a plurality of radiant panels, passive chilled beams, or active chilled beams in fluid communication with the second refrigeration system. The air conditioning system can also include a pump circulating a working fluid from the second refrigeration system, to the radiant cooling panels or chilled beams, to the air handling unit second heat exchanger, and back to the second refrigeration system.

In one example, the first refrigeration system is a direct expansion type refrigeration system. In one example, the second refrigeration system is an air-cooled chiller. In one example, each terminal unit includes at least one of the plurality of radiant cooling panels or chilled beams.

In one example, the second working fluid is one of water, glycol, and a combination of water and glycol. In one example, the step of cooling the supply airflow with a fourth heat exchanger is performed prior to the step of cooling the supply airflow with the first heat exchanger. In one example, the step of cooling the supply airflow with the fourth heat exchanger includes transferring heat from a return airflow from the interior space to the supply airflow. In one example, the method includes a step of cooling the supply airflow with the fourth heat exchanger by passing the supply and return airflows through a passive desiccant enthalpy wheel. In one example, the first refrigeration system is a direct expansion type system and the second refrigeration system is an air cooled chiller. In one example, the step of cooling the one or more radiant cooling panels or chilled beams with the second working fluid includes delivering the second working fluid to the radiant cooling panels or chilled beams at a temperature that is equal to or above a measured dew point temperature of the interior space.

An air handling unit providing a supply airflow can include an enclosure defining a first airflow path extending between a first air inlet and a first air outlet and defining a second airflow path extending between a second air inlet and a second air outlet; a first fan located between the first air inlet and outlet; an air-to-air heat exchanger extending between the first and second airflow paths; a first coil section located in the first airflow path between the energy recovery wheel and the first air outlet, the first coil section being configured to provide cooling to air flowing through the first coil section with a first refrigerant; a second coil section located in the first airflow path and between the first cooling coil section and the first outlet, the second coil section being configured to provide cooling to air flowing through the second coil section with a second refrigerant; and a third coil section located in the first airflow path and between the first air inlet and the energy recovery wheel, the third coil section being configured to provide heating to air flowing through the third coil section with the second refrigerant.

In some examples, the first refrigerant is a hydrofluorocarbon-based refrigerant.

In some examples, the second refrigerant is a water-based fluid.

In some examples, the unit further includes a first refrigeration system that provides cooling to the first coiling coil via the first refrigerant and a second refrigeration system configured to provide cooling to terminal units associated with the air handling system and heating to the second coil section, and that is in fluid communication with the second and third coil sections.

In some examples, the second refrigeration system is an air-cooled chiller or a reverse cycle heat pump.

In some examples, the air-to-air heat exchanger is a passive desiccant enthalpy wheel.

An air conditioning system can include a plurality of terminal units in fluid communication with the supply airflow generated by the air handling unit, each of the plurality of terminal units being provided with a wireless control system including controller in communication with a temperature sensor and control valve associated with the terminal unit; a plurality of radiant panels or chilled beams in fluid communication with the second refrigeration system; and a pump circulating a working fluid from the second refrigeration system, to the radiant cooling panels or chilled beams, to the air handling unit second heat exchanger, and back to the second refrigeration system.

In some examples, each terminal unit includes at least one of the plurality of radiant panels or chilled beams.

In some examples, a hybrid coil includes a casing having an inlet end and an outlet end; a plurality of heat exchanging fins extending between the inlet and outlet ends; a first coil section located in the casing, the first coil section including tubing extending between a first inlet and a first outlet configured for connection with a first refrigeration system using a first working fluid; and a second coil section located in the casing between the outlet end and the first coil, the second coil section including tubing extending between a second inlet and a second outlet configured for connection with a second refrigeration system using a second working fluid different from the first working fluid.

In some examples, the first working fluid is a hydrofluorocarbon-based refrigerant.

In some examples, the second working fluid is a water-based fluid.

In some examples, the tubing of the first coil section and the tubing of the second coil section both extend through the plurality of fins.

In some examples, the tubing of the first coil section and the tubing of the second coil section are formed from copper tubing and the plurality of fins are formed from an aluminum material.

A method of conditioning a space is also disclosed. The method can include the steps of cooling a first working fluid with a first refrigeration system, cooling a second working fluid with a second refrigeration system, cooling a supply air flow with a first heat exchanger utilizing the first working fluid, heating the supply airflow with a second heat exchanger utilizing the second heat exchanger, cooling one or more radiant cooling panels or chilled beams utilizing the second working fluid prior to the step of heating the supply airflow with the second working fluid, and delivering the supply airflow to an interior space.

In some examples, the second working fluid is one of water, glycol, and a combination of water and glycol.

In some examples, the method includes the step of cooling the supply airflow with a third heat exchanger prior to the step of cooling the supply airflow with the first heat exchanger.

In some examples, the step of cooling the supply airflow with the fourth heat exchanger includes transferring heat from a return airflow from the interior space to the supply airflow.

In some examples, the step of cooling the supply airflow with the third heat exchanger includes passing the supply and return airflows through a passive desiccant enthalpy wheel.

In some examples, the first refrigeration system is a direct expansion type system and the second refrigeration system is an air cooled chiller.

In some examples, the step of cooling the one or more radiant cooling panels or chilled beams with the second working fluid includes delivering the second working fluid to the radiant cooling panels or chilled beams at a temperature that is equal to or above a measured dew point temperature of the interior space.

A variety of additional aspects will be set forth in the description that follows. The aspects can relate to individual features and to combinations of features. It is to be understood that both the forgoing general description and the following detailed description are exemplary and explanatory only and are not restrictive of the broad inventive concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is presented below.

DETAILED DESCRIPTION

Figure 1:
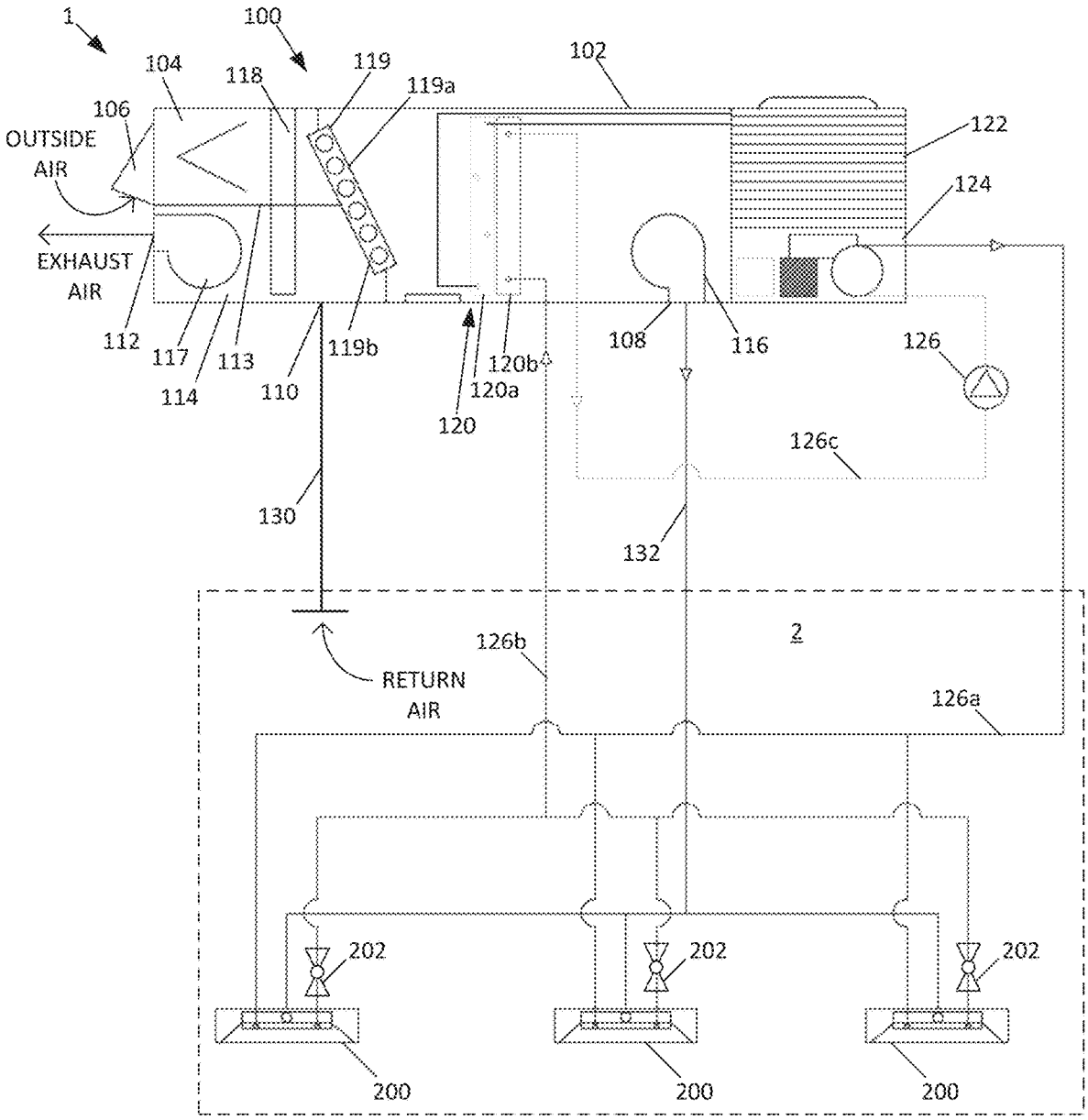
FIG. 1 is a schematic representation of a system utilizing an integrated chilled beam/chiller direct outside air path unit.
Figure 2:
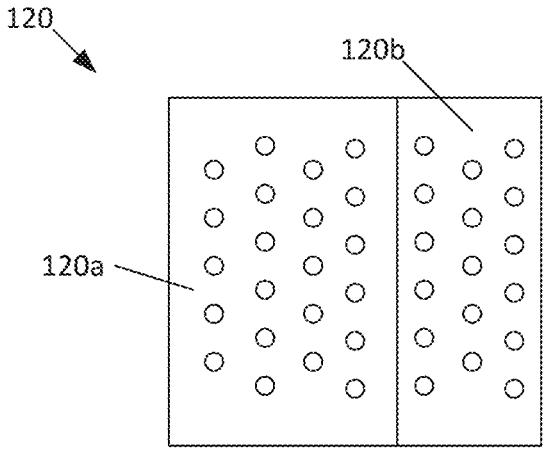
FIG. 2 is a schematic representation of a cooling coil suitable for use within the air handling system shown in FIG. 1.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible examples for the appended claims. Referring to the drawings wherein like reference numbers correspond to like or similar components throughout the several figures.

As shown, the conditioning system 1 includes an air handling system 100 that provides conditioned air and cooling water to a plurality of terminal units 200.

The air handling system 100 is defined by an enclosure 102. In one aspect, the enclosure includes a first air inlet 106 and a first air outlet 108, between which a process air flow path 104 extends. In the example shown, the first air inlet 106 is in communication either directly or via ductwork with the outside air at ambient conditions. The enclosure 102 is also shown as including a second air inlet 110 and a second air outlet 112, between which a regeneration air flow path 114 extends. The process and regeneration air flow paths 104, 114 are shown as being separated by an internal wall 113. A process air fan 116 may be provided to move air through the process airflow path while a regeneration air fan 117 may be provided to move air through the regeneration airflow path 114.

The air handling system 100 also has an energy recovery wheel 118, for example a passive desiccant energy recovery wheel, extending between the process and regeneration airflow paths 104, 114. As the energy recovery wheel 118 rotates, the wheel 118 transfers heat and humidity between the process and regeneration airflow paths 104, 114. In one implementation, return air (from the conditioned space 2) is drawn through a portion of the wheel 118 extending within the regeneration air flow path 114 by the regeneration fan 117 while outside air is drawn through a portion of the wheel 118 disposed in the process air flow path 104. Under certain conditions, the cooler and dryer return air in the regeneration airflow path absorbs heat and moisture from the outside air in the process airflow path via the energy recovery wheel 118 such that the process air is preconditioned.

In the example shown, ductwork 130 extends between the space 2 and the second air inlet 110 such that return air can be delivered to the air handling system 100. Ductwork 132 is also shown as being provided between the terminal units 200 and the air outlet 108 of the air handling system 100 such that supply air can be delivered to the terminal units 200 by the air handling system 100. In one aspect, the air handling system 100 is provided with a damper assembly 119. As shown, the damper assembly 119 has a first section 119*a* that controls the volume of outside air entering through inlet 106 and a second section 119*b* that controls the volume of exhaust air exiting through outlet 112. The position of the damper assemblies 119*a* and 119*b* can be positioned (e.g. via actuators operated via a building automation system) to control the ratio of return air from the space 2 and outside air entering from inlet 106 that is delivered to the back to the space 2 via the process fan 108 and to control the amount of exhaust air that exits outlet 112. Where damper assembly 119*a* is positioned in a completely opened position and damper assembly 119*b* is positioned in a completely closed position, the air handling system 100 will deliver 100 percent outside air from inlet 106 to the space 2 via fan 116. Where damper assembly 119*a* is positioned in a completely closed position and damper assembly 119*b* is positioned in a completely open position, the air handling system 100 will deliver 100 percent return air from inlet 110 to the space 2 via fan 116. Accordingly, the dampers 119*a*, 119*b* can be cooperatively positioned at any desired intermediate position to achieve a desired percentage of outside air delivered to the space 2.

Figure 3:
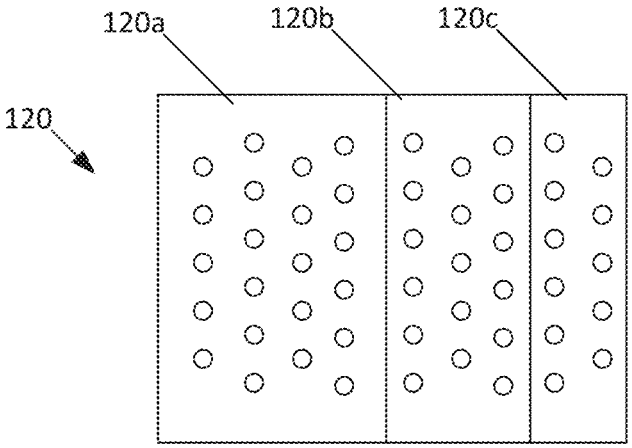
FIG. 3 is a schematic representation of a cooling coil suitable for use within the air handling system shown in FIG. 1.

As shown, the air handling system 100 further includes a hybrid coil system 120 having a first section 120*a* and a second section 120*b*. In one arrangement, the first section 120*a* is a direct expansion or "DX" type coil and the second section 120*b* is a liquid-to-air heat exchanger coil that utilizes a liquid as the heat transfer mechanism. The coil assembly can be provided with a unitary construction such that the sections 120*a* and 120*b* are joined together such that the coils utilize common heat transfer fins that traverse across both sections, as illustrated at FIGS. 2 and 6 to 9. The sections 120*a*, 120*b* may also be provided as separate coils that are then later joined together or mounted separately within the process air flow path 104. In the example shown at FIGS. 6 to 9, the coil sections 120*a*, 120*b* are fully integrated into a single casing 120*d* such that the hybrid coil 120 can be installed into the air handling system 100' as a single unit. In one aspect, a plurality of metal fins 120*e* extend between a front and back face of the casing 120*d*, wherein tubing 120*f* associated with the first section 120*a* and tubing 120*g* associating with the second section 120*b* serpentine through the fins 120*e*. As shown, the first section 120*a* has a first inlet 120*h* and a first outlet 120*i* in fluid communication with the tubing 120*f*. A plurality of branch lines 120*j*, shown schematically, extend from the first inlet 120*h* extend to the tubing 120*f*. As mentioned previously, a refrigerant coolant, such as a hydrofluorocarbon-based refrigerant (e.g. HFCs including R410A and R134), can flow through the first section 120*a*, from the first inlet 120*h*, the branch lines 120*j*, the tubing 120*f*, and then to the outlet. As shown, the second section 120*b* has a second inlet 120*k* and a second outlet 120*m* in fluid communication with the tubing 120*g*. As mentioned previously, a liquid working fluid or coolant, such as water and/or glycol, can flow through the second section 120*b*, from the second inlet 120*k*, through the tubing 120*g*, and then to the second outlet 120*m*. Referring to FIG. 3, an alternative arrangement is presented in which a third section 120*c* is provided that transfers heat from a modulating hot gas bypass system to the process air (i.e. a gas reheat coil). As shown, the third section is shown downstream of the second section 120*b*. In one example, the fins 120*e* are formed from an aluminum material and the tubing 120*f*, 120*g* is formed from copper tubing. With the disclosed design, the hybrid coil 120 saves room, thereby allowing for hot gas reheat to be located after the hybrid coil 120 more easily, if desired.

Figure 4:
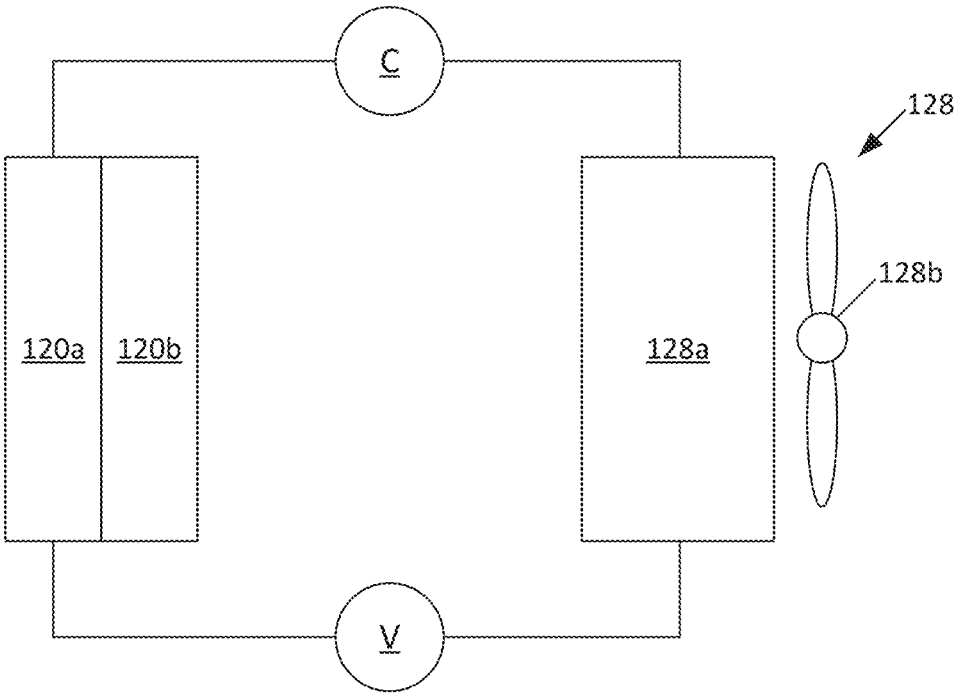
FIG. 4 is a schematic representation of a direct expansion cooling system usable in the integrated chilled beam/chiller direct outside air path unit shown in FIG. 1.

The air handling system 100 is additionally shown as including a first refrigeration system 122 and a second refrigeration system 124. In one embodiment, the first refrigeration system 122 is a direct expansion type system including one or more compressors C and one or more expansion valves V in fluid communication with the hybrid coil assembly first section 120*a*. The first refrigeration system 122 can further include a condensing unit or section 128 including a condensing coil 128*a* and fan 128*b* for condensing the refrigerant circulating through the hybrid coil assembly first section 120*a*, as schematically depicted at FIG. 4.

In one embodiment, the second refrigeration system 124 is an air cooled chiller system including one or more compressors and evaporators that cool a liquid refrigerant circulated between the hybrid coil assembly second section 120*b* and one or more compressor(s). The liquid refrigerant can be water, glycol, or a combination of water and glycol, or any other suitable heat transfer fluid. The air cooled chiller system 124 can further include a condensing unit or section including a condensing coil and fan for condensing the refrigerant circulating through the hybrid coil assembly first section 120*a*. The second refrigeration system 124 can also be configured as a reverse cycle heat pump, operable in a cooling mode or a heating mode, such that both heating and cooling can be provided to the terminal units 200. The second refrigeration system 124 could also be alternatively configured as a water cooled chiller.

As shown, each of the first and second refrigeration systems is packaged within the air handling unit enclosure 102 such that a single resulting structure exists. Such a configuration is advantageous in that all major mechanical equipment associated with the system 1 can be delivered to a job site and installed, for example on a roof, in a single step with much of the piping and associated components already installed.

The second refrigeration system 124 also includes a pump 126 and associated piping 126*a*, 126*b*, 126*c*, configured such that the pump 126 pumps water through an evaporator and then to terminal units 200 within the building via supply piping 126*a*. The volume of water delivered to each terminal units 200 can be controlled via individual control valves 202, which can be operated to maintain a room temperature set point via a room temperature sensor. An example terminal unit 200 suitable for use in the disclosed design is shown and described in U.S. Patent Application Publication US 20120270494 A1, the entirety of which is incorporated by reference herein.

From the terminal units 200, the chilled water is routed to the hybrid coil assembly second section 120*b* via intermediate piping 126*b* and then back to the pump 126 via return piping 126*c*. With this routing, the second refrigeration system 124 can be configured to generate 58 degree F. chilled water that is delivered to the terminal units 200 via supply piping 126*a*. In one example, the terminal units 200 perform only sensible cooling and such a chilled water supply temperature is sufficient to provide cooling without condensing moisture from the air passing through the terminal unit 200. After passing through the terminal units 200, the chilled water is delivered to the second section 120*b* at an elevated temperature, for example at about 64 degrees F., via intermediate piping 126*b*. Typically, the first refrigeration system 122 and first section 120*a* will cool the air down to a temperature that is lower than desired for delivery to the terminal units 200 and that is below the temperature of the chilled water being delivered to the second section 120*b*. In one example, the air passing through the second section 120*b* decreases the chilled water temperature, for example from about 64 degrees F. to about 62 degrees F. Concurrently, the air passing through the second section 120*b* is heated. This approach can eliminate the need for reheating the air via other means, such as a hot gas bypass system associated with the first refrigeration system 122. Where the second refrigeration system 124 is configured as a reverse cycle heat pump and operating in the heating mode providing, for example, 140 degree F. water to the second section 120*b*, the condensate from the first section 120*a* could be entirely evaporated. As noted previously, if further reheating is desired, a third section 120*c* can be provided that does utilize heat from a hot gas bypass system, as shown at FIG. 3. From the second section 120*b* of the coil arrangement 120, water is returned to the second refrigeration system 124 via piping 126*c*, thus completing the circuit such that the water can be cooled and returned to the terminal units via operation of the pump 126.

Figure 5:
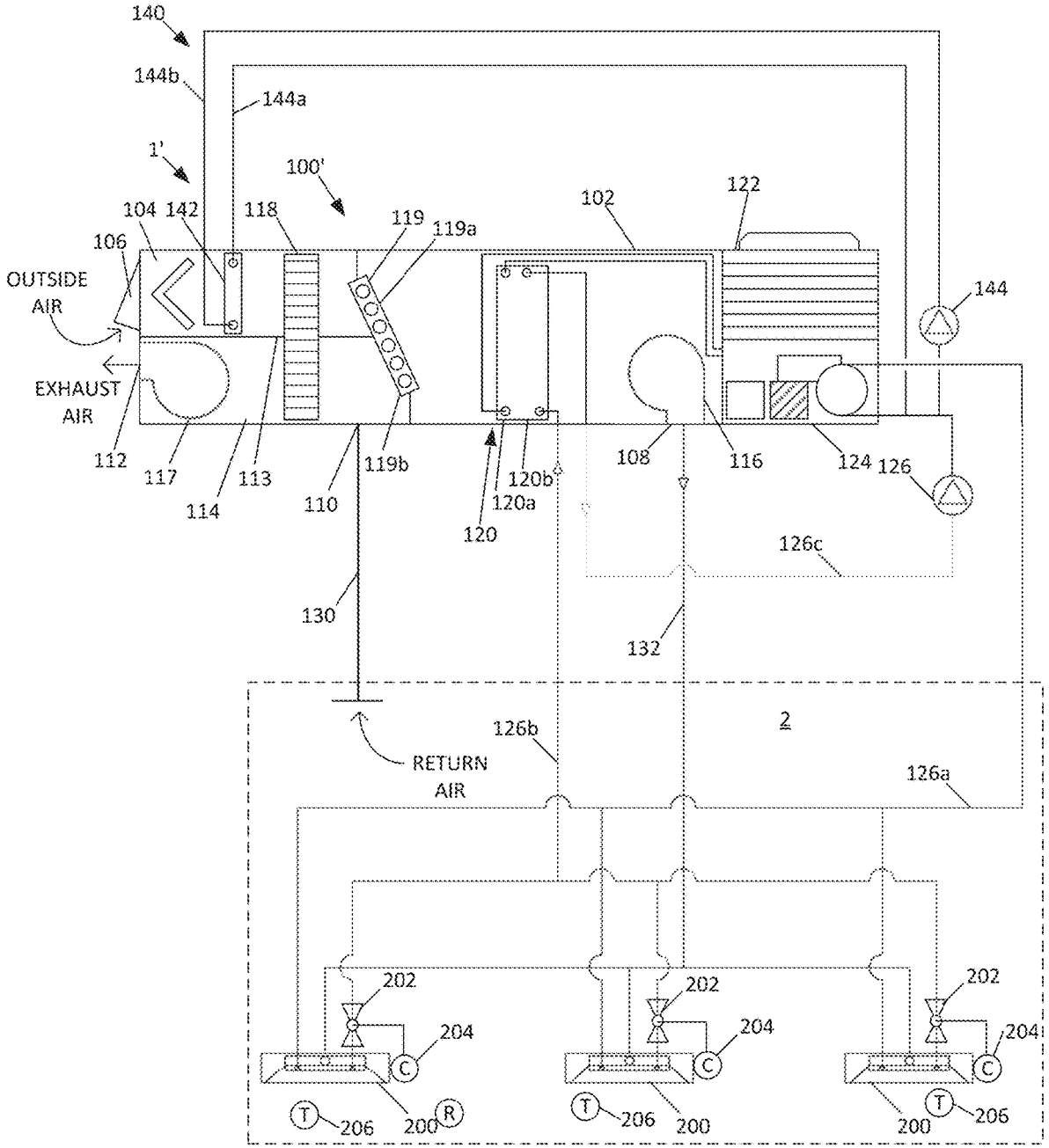
FIG. 5 is a schematic representation of a system utilizing an integrated chilled beam/chiller direct outside air path unit.
Figure 6:
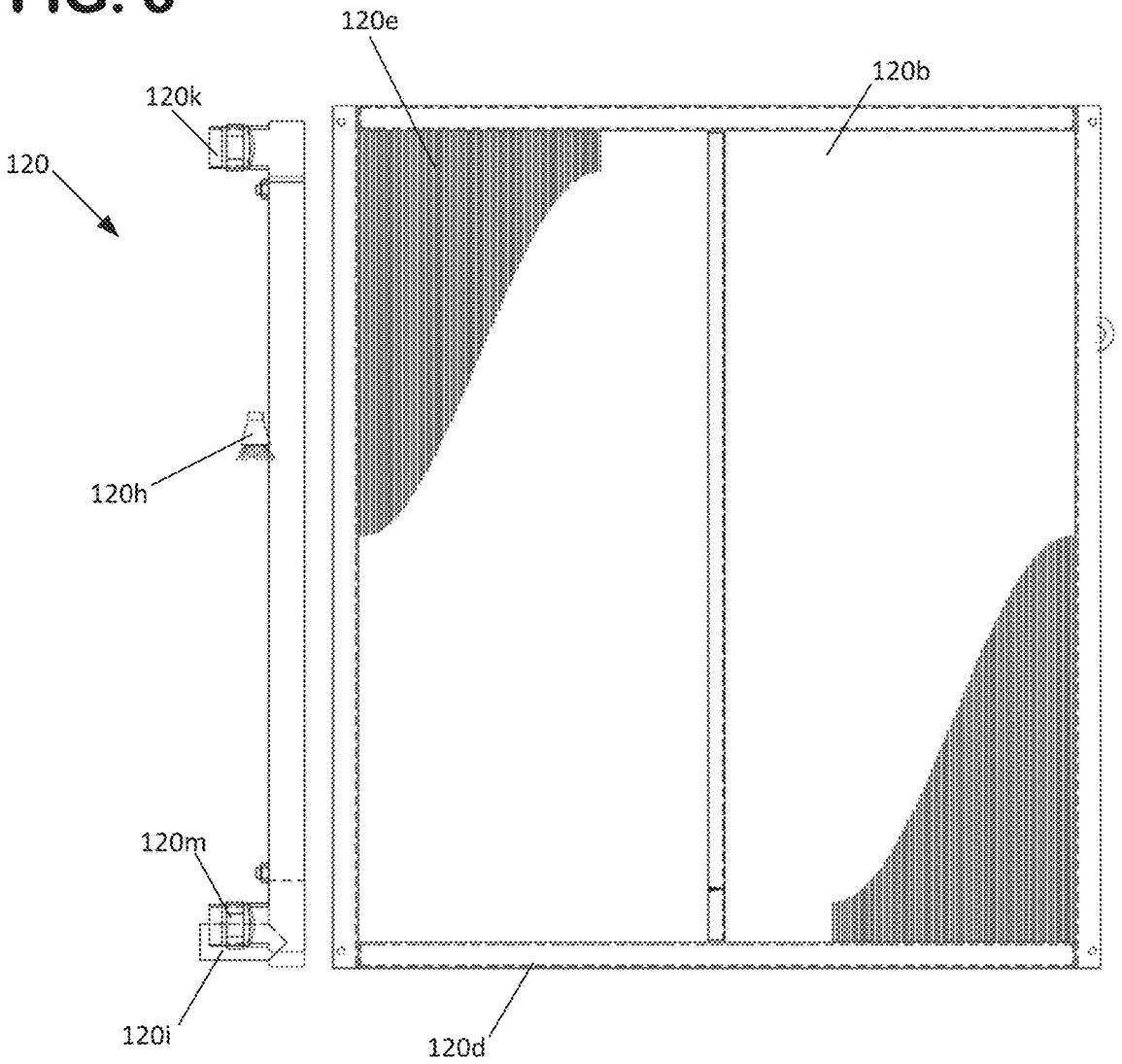
FIG. 6 is a front view of a cooling coil suitable for use with the air handling systems shown in FIGS. 1 and 5.
Figure 7:
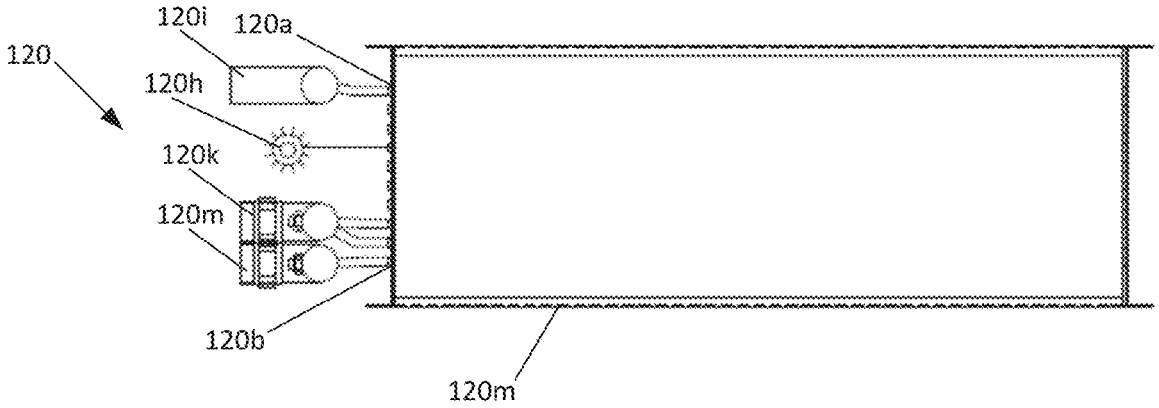
FIG. 7 is a top view of the cooling coil shown in FIG. 6.
Figure 8:
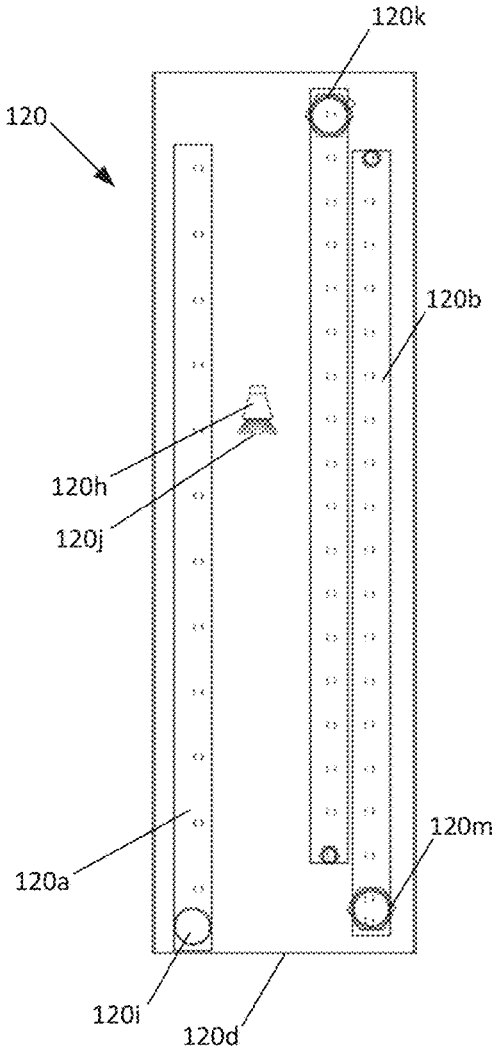
FIG. 8 is a first side view of the cooling coil shown in FIG. 6.
Figure 9:
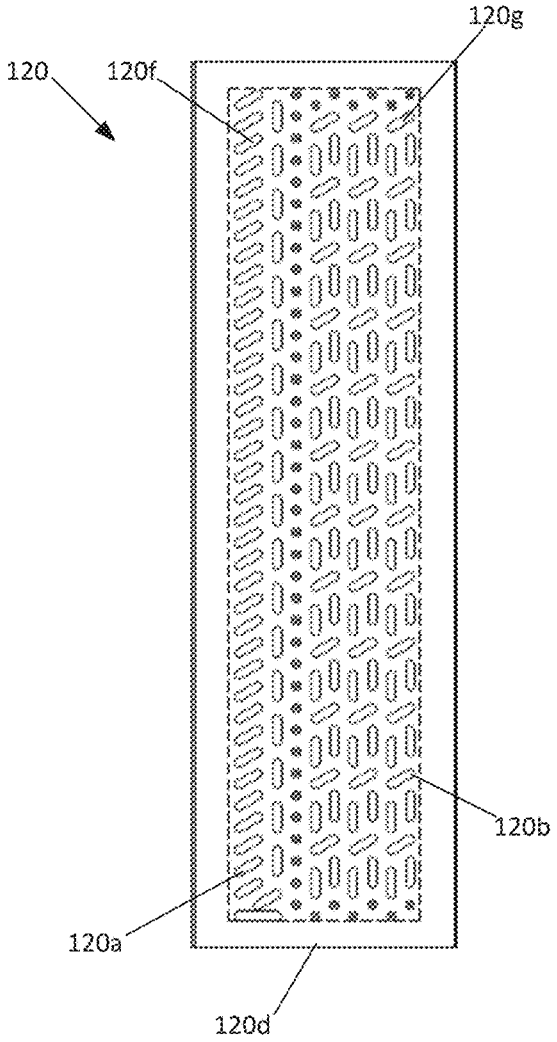
FIG. 9 is a second side view of the cooling coil shown in FIG. 6.

Referring to FIG. 5, a second example of an air conditioning system 1' is presented in which includes a modified air handling system 100' that provides conditioned air and cooling water to the plurality of terminal units 200. The air handling system 100' has many features in common with air handling system 100. Accordingly, the description for air handling system 100 is largely applicable to air handling system 100'.

The air handling system 100' differs from air handling system 100 primarily in that a hydronic system 140 is provided including a coil 142 located in the air handling system 100' between the first air inlet 106 and the energy recovery wheel 118. The coil 142 is in fluid communication with a pump 144 via branch lines 144*a*, 144*b* which further extend to line 126*c*, 126*c*. Accordingly, when the pump 144 is activated, fluid from line 126*c* is pumped through the coil 142 and back to line 126*c* at a downstream location. In the example shown, the fluid flowing through branch 126*c* is at the warmest point in the second refrigeration system 124 when the second refrigeration system 124 is in a cooling mode. In one mode of operation, when the pump 126 and second refrigeration system 124 are activated in a cooling mode, the pump 144 can be activated when the temperature of the air entering inlet 106 is below a predetermined threshold or a relative threshold, for example when the entering air is below the temperature of the fluid in line 126 returning to the second refrigeration system 124. Under such circumstances, the coil 142 functions to elevate the temperature of the air from inlet 106 passing through the coil 142, which can advantageously provide a frost-control/prevention function for the energy recovery wheel 118. Raising the temperature in this way enables the energy recovery wheel 118 to rotate at a higher rate since the speed of the wheel does not need to be slowed to the same extent to avoid frost build-up on the wheel, therefore resulting in greater heat transfer across the wheel 118. Furthermore, this operation will operate to cool the fluid passing through the coil 142, thus lowering the temperature of the fluid returning to the second refrigeration system 124 and therefore lowering the load on the second refrigeration system 124. For example, where the fluid temperature in the line 126*c* is about 62 degrees, the coil 142 can lower the temperature returned back to line 126*c* to a temperature below 62 degrees. With the disclosed configuration, the hydronic system 140 can be characterized as providing a fluid-side economizer for the second refrigeration system 124, and the coil 142 can be characterized as an economizer and/or pre-heat coil. In one illustrative example, the coil 142, with an airflow of about 1,850 cfm and fluid/liquid flow rate of about 45 gpm, heats the air entering the coil 142 from about 51 degrees to about 63 degrees and lowers the fluid/liquid temperature from about 67 degrees to about 65.8 degrees. The lowering of the fluid/liquid temperature through the coil thus provides an energy credit back to the second refrigeration system 124 while simultaneously providing pre-heat air to the energy recovery wheel 142.

In the example shown at FIG. 5, the terminal units 200 are provided with packaged controls, such that the control valve 202 and a controller 204 that can wirelessly communicate with the air handling system 100' and/or the associated building automation system. In one aspect, the controller 204 provides an output to the control valve 202 to control the position of the valve 202 to maintain a temperature set point, for example a set point temperature associated with a room thermostat or temperature sensor 206. In some examples, the controller 204 can directly receive an input from the temperature sensor 206, either via a hard wired connection or via a wireless connection. The terminal unit 200 can be provided with the temperature sensor 206 and the controller 204 can be preconfigured to communicate with the temperature sensor 206 such that an installer can more easily install the system. In one aspect, the controller 204 can include a processor and a non-transient storage medium or memory, such as RAM, flash drive or a hard drive. Memory is for storing executable code, the operating parameters, and the input from the operator user interface while processor is for executing the code. The controller 204 can also include transmitting/receiving ports, such as a CAN bus connection or an Ethernet port for two-way communication with a WAN/LAN related to an automation system and to interrelated controllers. A user interface may be provided to activate and deactivate the system, allow a user to manipulate certain settings or inputs to the controller 204, and to view information about the system operation.

The controller 204 typically includes at least some form of memory. Examples of memory include computer readable media. Computer readable media includes any available media that can be accessed by the processor. By way of example, computer readable media include computer readable storage media and computer readable communication media. Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the processor.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media. In examples, the controller 204 communicates with a system-level controller associated with a building and/or the air handling system 100 or 100' over a secure and encrypted 900 MHz wireless mesh network. In examples, the controller 204 and/or sensor 206 communicated with each other and/or with a supervisory controller via Bluetooth pairing. In some examples, the controller 204 and/or sensor 206 are SMART NODE and SMART STAT (or WALL SENSOR) branded components provided by 75F of Bloomington, Minn.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed is:

1. An air handling unit providing a supply airflow, the air handling unit including:

a) an enclosure defining a first airflow path extending between a first air inlet and a first air outlet and defining a second airflow path extending between a second air inlet and a second air outlet;

b) a first fan located between the first air inlet and the first air outlet;

c) an air-to-air heat exchanger extending between the first and second airflow paths;

d) a first coil section located in the first airflow path between the air-to-air heat exchanger and the first air outlet, the first coil section being configured to provide cooling to air flowing through the first coil section with a first refrigerant;

e) a second coil section located in the first airflow path and between the first coil section and the first air outlet, the second coil section being configured to provide cooling to air flowing through the second coil section with a second refrigerant; and f) a third coil section located in the first airflow path and between the first air inlet and the air-to-air heat exchanger, the third coil section being configured to provide heating to air flowing through the third coil section with the second refrigerant.

2. The air handling unit of claim 1, wherein the first refrigerant is a hydrofluorocarbon-based refrigerant.

3. The air handling unit of claim 1, wherein the second refrigerant is a water-based fluid.

4. The air handling unit of claim 1, further comprising:

a) a first refrigeration system that provides cooling to the first coil section via the first refrigerant;

b) a second refrigeration system configured to provide cooling to terminal units associated with the air handling system and heating to the second coil section, and that is in fluid communication with the second and third coil sections.

5. The air handling unit of claim 4, wherein the second refrigeration system is an air-cooled chiller or a reverse cycle heat pump.

6. The air handling unit of claim 1, wherein the air-to-air heat exchanger is a passive desiccant enthalpy wheel.

7. An air conditioning system comprising:

a) the air handling unit of claim 4;

b) a plurality of terminal units in fluid communication with supply airflow generated by the air handling unit, each of the plurality of terminal units being provided with a wireless control system including a controller in communication with a temperature sensor and a control valve associated with the terminal unit;

c) a plurality of radiant panels or chilled beams in fluid communication with the second refrigeration system; and d) a pump circulating a working fluid from the second refrigeration system to the plurality of radiant cooling panels or chilled beams, to a second heat exchanger of the air handling unit, and back to the second refrigeration system.

8. The air conditioning system of claim 7, wherein each terminal unit includes at least one of the plurality of radiant panels or chilled beams.

9. The hybrid coil of claim 1, wherein the first working fluid is a hydrofluorocarbon-based refrigerant.

10. The hybrid coil of claim 1, wherein the second working fluid is a water-based fluid.

11. The hybrid coil of claim 1, wherein the tubing of the first coil section and the tubing of the second coil section both extend through the plurality of fins.

12. The hybrid coil of claim 1, wherein the tubing of the first coil section and the tubing of the second coil section are formed from copper tubing and the plurality of fins are formed from an aluminum material.

13. A hybrid coil for use in an air handling system, the hybrid coil comprising:

a) a casing having an inlet end and an outlet end;

b) a plurality of heat exchanging fins extending between the inlet and outlet ends;

c) a first coil section located in the casing, the first coil section including tubing extending between a first inlet and a first outlet configured for connection with a first refrigeration system using a first working fluid; and d) a second coil section located in the casing between the outlet end and the first coil section, the second coil section including tubing extending between a second inlet and a second outlet configured for connection with a second refrigeration system using a second working fluid different from the first working fluid.

14. A method of conditioning a space, the method comprising:

a) cooling a first working fluid with a first refrigeration system;

b) cooling a second working fluid with a second refrigeration system;

c) cooling a supply air flow with a first heat exchanger utilizing the first working fluid;

d) heating the supply airflow with a second heat exchanger utilizing the second working fluid;

e) cooling one or more radiant panels or chilled beams utilizing the second working fluid prior to the step of heating the supply airflow with the second working fluid; and f) delivering the supply airflow to an interior space.

15. The method of claim 14, wherein the second working fluid is one of water, glycol, and a combination of water and glycol.

16. The method of claim 14, further including the step of cooling the supply airflow with a third heat exchanger prior to the step of cooling the supply airflow with the first heat exchanger.

17. The method of claim 16, wherein the step of cooling the supply airflow with the third heat exchanger includes transferring heat from a return airflow from the interior space to the supply airflow.

18. The method of claim 16, wherein the step of cooling the supply airflow with the third heat exchanger includes passing the supply and return airflows through a passive desiccant enthalpy wheel.

19. The method of claim 14, wherein the first refrigeration system is a direct expansion type system and the second refrigeration system is an air cooled chiller.

20. The method of claim 14, wherein the step of cooling the one or more radiant cooling panels or chilled beams with the second working fluid includes delivering the second working fluid to the radiant cooling panels or chilled beams at a temperature that is equal to or above a measured dew point temperature of the interior space.

* * * * *